US006460714B1

(12) United States Patent
Silvers et al.

(10) Patent No.: US 6,460,714 B1
(45) **Date of Patent: *Oct. 8, 2002**

(54) PASTEURIZATION PANELS FOR A PLASTIC CONTAINER

(75) Inventors: Kerry W. Silvers, Chelsea, MI (US); Timothy J. Boyd, Ypsilanti, MI (US); Dwayne G. Vailliencourt, Manchester, MI (US); Richard J. Steih, Britton, MI (US)

(73) Assignee: Schmalbach-Lubeca AG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/293,069

(22) Filed: Apr. 16, 1999

Related U.S. Application Data

(60) Provisional application No. 60/126,776, filed on Mar. 29, 1999.

(51) Int. Cl.[7] ..... B65D 90/02

(52) U.S. Cl. ..... 215/381; 220/609

(58) Field of Search ..... 220/44, 66, 69, 220/94, 608, 609, 1 B, 666; 215/1 C, 381, 384, 382, 383

(56) References Cited

U.S. PATENT DOCUMENTS

| | | | | |
|---|---|---|---|---|
| 3,325,031 A | * | 6/1967 | Singier | 215/381 X |
| 3,690,500 A | * | 9/1972 | Remane | 220/1 B |
| 4,497,855 A | | 2/1985 | Agrawal et al. | |
| 4,818,575 A | | 4/1989 | Hirata et al. | |
| 4,863,046 A | | 9/1989 | Collette et al. | |
| 4,890,752 A | * | 1/1990 | Ota et al. | 215/1 C |
| 5,054,632 A | | 10/1991 | Alberghini et al. | |
| 5,092,475 A | | 3/1992 | Krishnakumar et al. | |
| 5,122,327 A | | 6/1992 | Spina et al. | |
| 5,141,120 A | * | 8/1992 | Brown et al. | 220/609 X |
| 5,178,289 A | | 1/1993 | Krishnakumar et al. | |
| 5,199,588 A | | 4/1993 | Hayashi | |
| 5,279,433 A | | 1/1994 | Krisnakumar et al. | |
| 5,303,833 A | | 4/1994 | Hayashi et al. | |
| 5,303,834 A | | 4/1994 | Krishnakumar et al. | |
| 5,337,909 A | | 8/1994 | Vaillencourt | |
| 5,341,946 A | | 8/1994 | Vaillencourt et al. | |
| 5,392,937 A | * | 2/1995 | Prevot et al. | 215/1 C |
| 5,407,086 A | | 4/1995 | Ota et al. | |
| RE35,038 E | * | 9/1995 | Smith et al. | 525/314 |
| 5,472,105 A | * | 12/1995 | Krishnakumar et al. | 220/609 X |
| 5,704,503 A | * | 1/1998 | Krishnakumar et al. | 215/381 |
| 5,735,420 A | | 4/1998 | Nakamaki et al. | |
| 5,908,128 A | | 6/1999 | Krishnakumar et al. | |
| 5,971,184 A | * | 10/1999 | Krishnakumar et al. | 215/384 |

FOREIGN PATENT DOCUMENTS

| | | |
|---|---|---|
| WO | 9703885 | 2/1997 |

* cited by examiner

*Primary Examiner*—Stephen P. Garbe
*Assistant Examiner*—Joseph C. Merek
(74) *Attorney, Agent, or Firm*—Harness, Dickey & Pierce, P.L.C.

(57) ABSTRACT

A sidewall portion for a plastic container used to receive a commodity and to retain the commodity during high temperature pasteurization and after cooling. The plastic container has an upper portion defining an aperture sealed by a closure, a lower portion forming a base, and a sidewall portion unitarily connected with and extending between the upper portion and the lower portion. The sidewall portion includes panels having a vacuum panel portion unitarily formed in and inwardly recessed from the sidewall, and a pressure panel portion unitarily formed with the vacuum panel portion. The pressure panel portion is movable from a first position to a second position during pasteurization thereby increasing the volume of the container and avoiding any significant deformation of the sidewall portion. The panels are movable from an increased volume position to a reduced volume position thereby decreasing the volume of the container and increasing apparent volume of the commodity in the container upon cooling after high temperature pasteurization.

17 Claims, 2 Drawing Sheets

PASTEURIZATION PANELS FOR A PLASTIC CONTAINER

This application claims the benefit of Provisional Application No. 60/126,776, filed Mar. 29, 1999.

TECHNICAL FIELD OF THE INVENTION

This invention generally relates to plastic containers. More specifically, this invention relates to sidewall portions of plastic containers and particularly to panels formed therein to accommodate any change in the pressure and volume inside the container during the pasteurization and after subsequent cooling of the contents of the container.

BACKGROUND

Thin-walled plastic containers with a bottle shape are popular for retaining liquid commodities, including pasteurizable liquid commodities, such as processed fruit juice. These containers are formed in a blow mold, from a material such as polyethylene terephthalate (PET), and are heat set resulting in plastic containers that have excellent mechanical strength and physical properties, and that are lightweight, inexpensive, recyclable, and manufacturable in large quantities.

Because of the numerous advantages, plastic containers for retaining pasteurizable solid commodities, such as pickles, are desirous. Unlike pasteurizable liquid commodities, pasteurizable solid commodities require a high temperature pasteurization process (hereafter just "high temperature pasteurization"), exceeding 80° C. and often peaking above 100° C. Because of the effects of these high temperatures on plastic containers, plastic containers used in high temperature pasteurization require different mechanical and physical properties than plastic containers used in low temperature pasteurization. Since the temperature of the commodity is raised during the pasteurization while the plastic container is sealed, high temperature pasteurization significantly increases the pressure inside the container, often more than 40 psi for a rigid (glass) container. The plastic containers of the conventional techniques in the art cannot accommodate these dramatic temperatures or the increase in pressure and these would unacceptably deform.

It is a further object of the present invention to provide a sidewall portion of a plastic container that accommodates the increase of internal pressure and volume generated by a high temperature pasteurization of a commodity in the container.

It is an additional object of the present invention to provide a sidewall portion of a plastic container that accommodates any subsequent reduction of internal pressure and volume caused by a cooling of the commodity in the plastic container.

SUMMARY OF THE INVENTION

Accordingly, this invention provides for a sidewall portion of a plastic container that overcomes the problems and disadvantages of the conventional techniques in the art. Specifically, the present invention provides for a sidewall portion of a plastic container that accommodates the increase of internal pressure and volume generated by a pasteurization of a commodity in the plastic container. The sidewall portion also accommodates any subsequent reduction of internal pressure and volume caused by a cooling of the commodity in the plastic container.

Briefly, the invention includes a sidewall portion for a plastic container used to receive a commodity and to retain the commodity during pasteurization and after cooling. The plastic container has an upper portion defining an aperture, a lower portion forming a base, and a sidewall portion unitarily connected with and extending between the upper portion and the lower portion. The sidewall portion includes a panel unitarily formed in and inwardly recessed from the sidewall, and includes a vacuum panel portion and a pressure panel, the latter being unitarily formed within the vacuum panel. The pressure panel portion is designed for movement from a first position to a second position thereby reducing the pressure generated in the container by the pasteurization of the commodity by increasing the container's volume while avoiding any deformation of the sidewall portion beyond the panel. The vacuum panel portion is movable from a pasteurization position to a cooled position thereby realizing a reduction in pressure and volume of the container and increasing the apparent volume of the commodity in the container.

Further features and advantages of the invention will become apparent from the following discussion and accompanying drawings.

DETAILED DESCRIPTION OF THE PREFERRED EMBODIMENT

The following description of the preferred embodiment is merely exemplary in nature, and is in no way intended to limit the invention or its application or uses.

Figure 1:
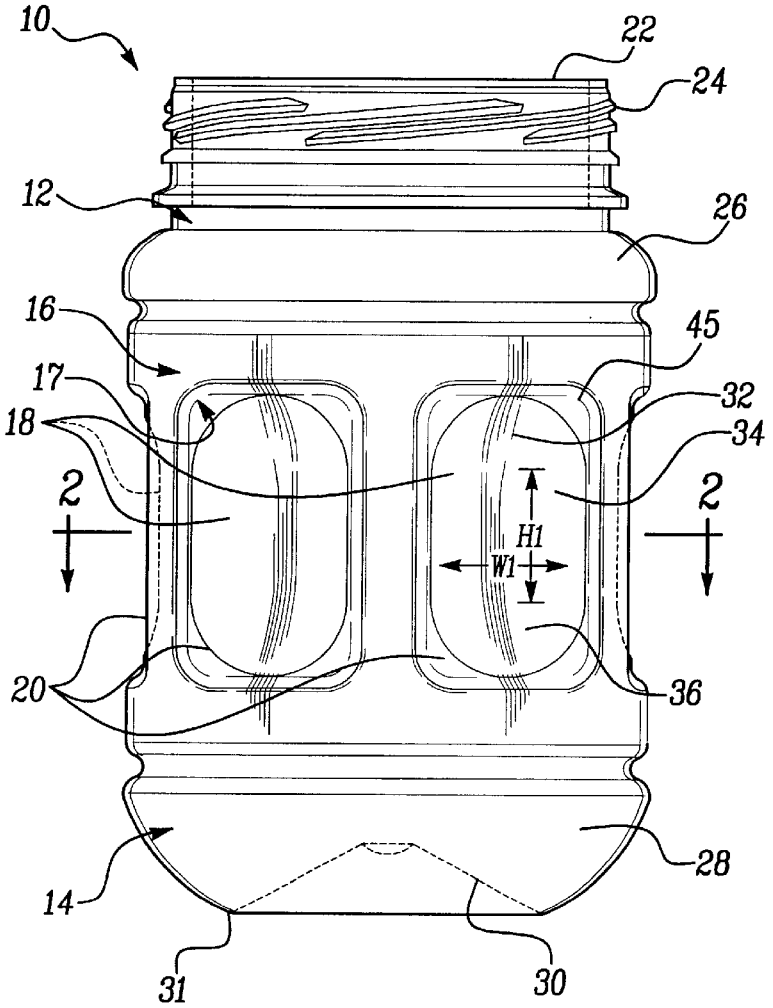
FIG. 1 is an elevation view of the plastic container with the panels according to the present invention in the receipt position.

The plastic container 10 of the present invention includes an upper portion 12, a lower portion 14, a sidewall portion 16, and a plurality of panels 17, each panel having a pressure panel portion 18 and a vacuum panel portion 20, as shown in FIG. 1.

The upper portion 12 of the plastic container 10 defines an aperture 22, and includes a threaded region 24 and a shoulder region 26. The aperture 22 allows the plastic container 10 to receive a commodity. The threaded region 24 provides an attachment for a similarly threaded cap (not shown), which preferably provides a hermetical seal for the plastic container 10. The shoulder region 26 provides a structural transition between the threaded region 24 and the sidewall portion 16.

The lower portion 14 of the plastic container 10 includes a base 28 closing off the bottom of the container with an inwardly recessed region 30. The base 28 functions to define a support or contact ring 31 of the plastic container 10. Together with the upper portion 12 and the sidewall portion 16, the base 28 functions to retain the commodity.

Formed in the sidewall portion 16 are the panels 17 mentioned above. In the figures, the panels 17 are seen as being equidistally spaced around the sidewall portion 16. While such spacing is preferred, other factors such as labeling requirements or the incorporation of grip features into the container, may require a spacing other than equidistant.

The pressure panel portion 18 of the plastic container 10 is unitarily formed within and moveable relative to the vacuum panel portion 20. In the preferred embodiment of the present invention, the pressure panel portion 18 has a generally oval or elliptical shape. The shape of the pressure panel portion 18 is designed as a unitary combination of three sections; a top section 32 having a semi-circular shape, a middle section 34 having a rectangular shape, and a lower section 36 having a semi-circular shape. In this configuration, the middle section 34 has a middle section height H1 and a middle section width W1. Preferably, the middle section height H1 measures at least 100% of the middle section width W1 and, most preferably, the middle section height H1 measures at least 150% of the middle section width W1.

Figure 2:
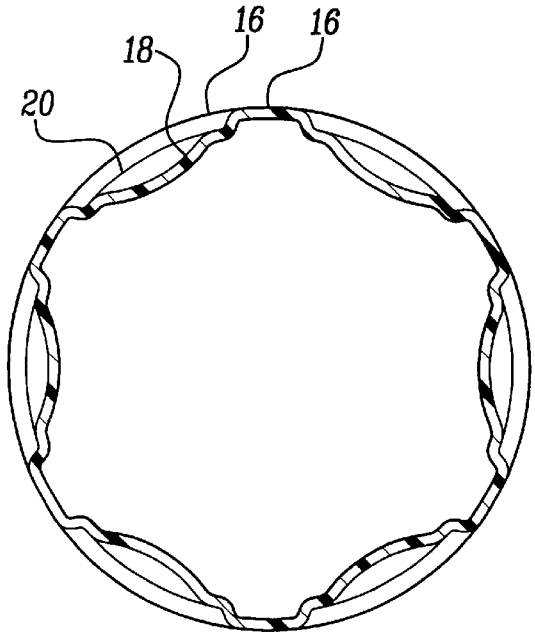
FIG. 2 is a cross-sectional view of the sidewall portion of plastic container, taken generally along the line 2—2 of FIG. 1.
Figure 3:
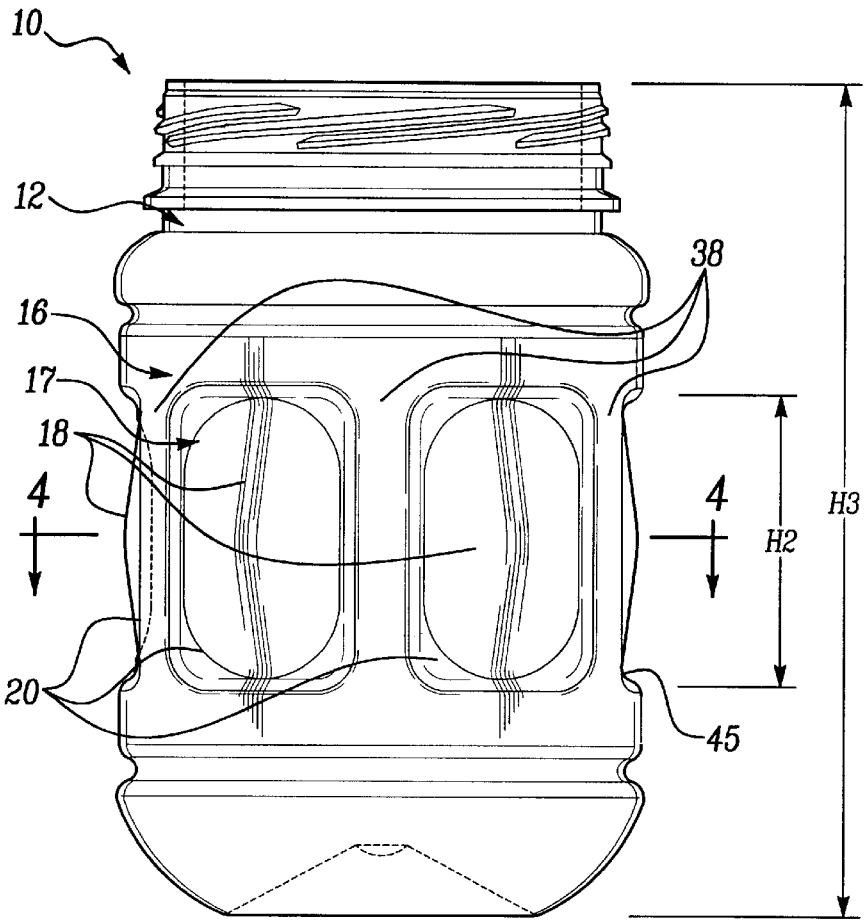
FIG. 3 is an elevation view of the plastic container with the panels according to the present invention in the pasteurization-position.
Figure 4:
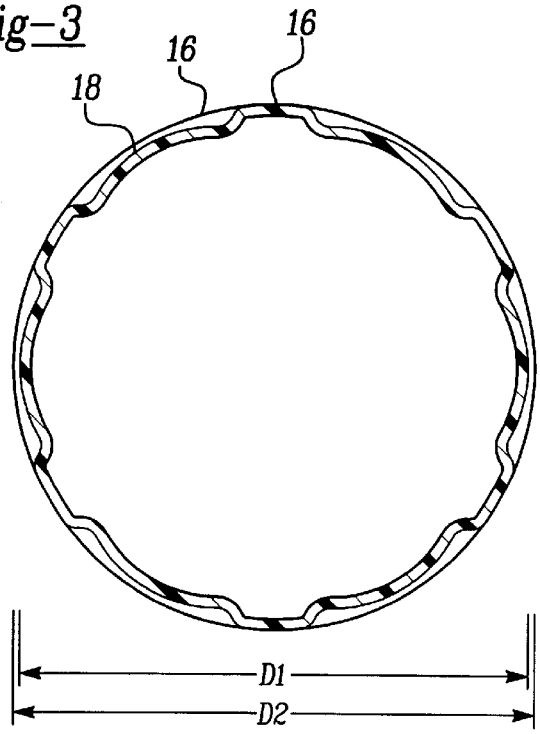
FIG. 4 is a cross-sectional view of the sidewall portion of plastic container, taken generally along the line 4—4 of FIG. 3.

The pressure panel portion 18 is initially formed in a first position with a slight inwardly bowed shape. The inwardly bowed shape has a vertical component, as shown in FIG. 1, and a transversal component, as shown in FIG. 2. The pressure panel portion 18 is moveable from the first position to a second position having an outwardly bowed shape. Like the inwardly bowed shape of the first position, the outwardly bowed shape of the second position has a vertical component, as shown in FIG. 3, and a transversal component, as shown in FIG. 4.

In the preferred embodiment of the present invention, the effective diameter D1 of the pressure panel portion 18 in the second position is less than the diameter D2 of the sidewall portion 16 of the plastic container 10. The difference between the effective diameter D1 and the diameter D2 allows a label (not shown) to be attached to the sidewall portion 16 above and below the panels 17 without any interference from the pressure panel portion 18 in the second position.

The vacuum panel portion 20 is unitarily formed in and inwardly recessed from the sidewall portion 16 of the plastic container 10 to ensure that the pressure panel portion 18 is properly recessed as mentioned above. In the preferred embodiment, the vacuum panel portion 20 has a generally rectangular shape. Preferably, the vacuum panel height H2 of the vacuum panel portion 20 measures at least 40% of the plastic container height H3 of the plastic container 10 and, most preferably, the vacuum panel height H2 measures at least 50% of the plastic container height H3. The plastic container height H3 being measured from the contact ring 31 to below the support flange 15.

Defined between adjacent panels 17 are lands or columns 38 that provide structural support and rigidity to the sidewall portion 16 of the plastic container 10.

The plastic container 10 is preferably blow-molded with a unitary construction from a plastic material such as polyethylene terephthalate (PET) resin. Alternatively, the plastic container 10 may be formed by other methods and from other conventional materials. Containers blow-molded with a unitary construction from a PET material are known and used in the art of plastic containers and their manufacture in the present invention would be readily understood by a person of ordinary skill in the art.

After blow molding, the container 10 is heat set. Preferably the heat setting process is such that the crystallinity of the panels 17 is at least 30%.

The plastic container 10 of the present invention is intended to be used to receive a commodity and to retain the commodity during pasteurization and after cooling. Although the plastic container 10 may be used to receive and retain various commodities, the plastic container 10 was especially invented and designed to receive and retain solid commodities, such as pickles. Unlike other commodities, such as some juices, pickles require a high temperature (greater than 80° C.) for their pasteurization. In some zones of the pasteurization oven, the temperature to which the container is exposed may exceed 100° C. For various reasons, the plastic container 10 is preferably sealed before the pasteurization of the commodity. Since the temperature is raised to approximately 100° C. and the plastic container 10 is sealed, the pasteurization of the commodity results in a significant increase in the pressure within the plastic container 10. If a plastic container did not incorporate the panels 17 of the present invention, the conventional plastic container would be subjected to an increase of approximately 40 psi, and would be permanently deformed or rupture. The plastic container 10 of the present invention, however, accommodates this increase of internal pressure as well as the corresponding increase in volume.

During the pasteurization, the pressure panel portion 18 moves in a controlled fashion under the influence of increased pressure and volume from its first position to its second position. By forming the pressure panel portion 18 with the three above mentioned sections, the upper, middle, and lower sections 32, 34, and 36, (with the upper and lower sections 32 and 36 transitioning into the vacuum panel portions 20) deformation of the pressure panel portion 18 is generally restricted and principally confined to the middle section 34. This movement into the second position increases the volume of the plastic container 10, thereby reducing the pressure in the plastic container 10 generated by the pasteurization of the commodity. By controlling and limiting this deformation to the pressure panel portion 18, deformation of the sidewall portion 16 is avoided.

In the preferred embodiment of the present invention, the pressure panel portion 18 is initially formed with a slightly inwardly bowed shape that inverts about an imaginary plane to an outwardly bowed shape in the pasteurization position. It is noted that in its outwardly bowed shape, the center of the pressure panel portion 18 exhibits the greatest deformation. The deformation is also such that the maximum diameter defined thereby is less than the overall container diameter, ensuring the ability of the container to accept a wrap-around or other style of label without causing bulging of the label.

Cooling of the commodity occurs after the pasteurization to reduce the temperature of the commodity to ambient temperature. Since the plastic container is sealed as the temperature is decreased, the cooling of the commodity significantly reduces the pressure inside the plastic container 10. To accommodate this reduction in pressure, the vacuum panel portions 20 move generally inward from a pasteurization position to a cooled position. Such movement is facilitated by the formation of the circumscribing shoulder 45 which defines the transition of the panel 17 from the sidewall portion 16 to the vacuum panel portion 20. The actual movement of the vacuum panel portions 20 may be slight. Because of the area of the overall panel 17, however, even slight inward movement results in a dramatic change in volume and accommodation of pressure reduction. As an added benefit of the vacuum panel potions 20, the reduction in the volume of the plastic container 10 increases the apparent volume of the commodity in the plastic container 10 and assists the marketability of the commodity and the plastic container 10.

During the pasteurization of some commodities, the pressure panel portions 18 themselves may move from the second position to a third position to assist the vacuum panel portions 20 in the accommodation of the reduced pressure inside the plastic container 10. The pressure panel portion 18 in the third position may be slightly less outwardly bowed than the pressure panel portion 18 in the second panel, may be inwardly bowed similar to the inwardly bowed shape of the first position, or may be shaped somewhere between the two positions. The actual movement of the pressure panel portion 18 from the second position to the third position will be determined by several factors, such as the initial position, the wall thickness, and the crystallinity of the pressure panel portion 18, the temperature used and the internal pressure generated during the pasteurization, and the size of the plastic container 10.

The foregoing discussion discloses and describes a preferred embodiment of the present invention. The person of ordinary skill in the art will readily recognize from such discussion, and from the accompanying drawings and claims, that changes and modifications can be made to the invention without departing from the true spirit and fair scope of the invention as defined in the following claims.

We claim:

1. A sidewall portion of a plastic container for receiving a commodity and retaining the commodity during high temperature pasteurization and subsequent cooling, the container having an upper portion defining an aperture and sealable with a closure, a lower portion forming a base, and a sidewall portion unitarily connected with and extending between the upper portion and the lower portion, wherein the sidewall portion comprises a plurality of generally rectangular shaped recessed panels formed therein and having an average crystallinity above 30%, said recessed panels including a substantially oval shaped pressure panel portion movable from a first inwardly bowed position to a second outwardly bowed position in response to an increase in the pressure of the container generated by high temperature pasteurization of the commodity thereby increasing the volume of the container and avoiding deformation of the sidewall portion, and a generally rectangular shaped vacuum panel portion surrounding said pressure panel portion and movable in response to a reduction in the pressure of the container due to the subsequent cooling of the commodity thereby decreasing the volume of the container.

2. The sidewall portion of claim 1, wherein said panels define a height measuring at least 40% of the plastic container's height.

3. The sidewall portion of claim 2, wherein said panel's height measures at least 50% of the plastic container's height.

4. The sidewall portion of claim 1, wherein adjacent panels generally define a column for structurally supporting the container during and after the pasteurization of the commodity.

5. The sidewall portion of claim 1, wherein said pressure panel defines a top section, a middle secton, and a bottom section, said top and bottom sections having a generally semi-cicular shape, and said middle section having a generally rectangular shape.

6. The sidewall portion of claim 5, wherein said middle section defines a middle section height and a middle section width, and said middle section's height measures at least 100% of said middle section's width.

7. The sidewall portion of claim 6, wherein said middle section's height measures at least 150% of said middle section's width.

8. The sidewall portion of claim 1, wherein said pressure panel portion in said second outwardly bowed position is located inwardly of the sidewall portion.

9. The sidewall portion of claim 1, wherein said pressure panel portion is substantially completely contained within said vacuum panel portion.

10. The sidewall portion of claim 1, wherein said pressure panel portion is movable from said second position to a third position.

11. The sidewall portion of claim 10, wherein said pressure panel portion is at least partially inwardly bowed in said third position.

12. The sidewall portion of claim 1, wherein said sidewall portion, said vacuum panel portion, and said pressure panel portion are capable of withstanding temperatures at least 80° C.

13. The sidewall portion of claim 12, wherein said temperature is at least 100° C.

14. The sidewall portion of claim 1, wherein said pressure panel portion is recessed relative to said vacuum panel portion.

15. The sidewall portion of claim 1, wherein said pressure panel portion is centered within said vacuum panel portion.

16. The sidewall portion of claim 1, wherein said outward bowed shape of said pressure panel portion is substantially confined to a middle section thereof.

17. A plastic container, comprising:

a base portion;

a sidewall portion connected with said base portion, said sidewall portion including a plurality of generally rectangular shaped panels formed therein having an average crystallinity above 30%, said plurality of recessed panels including a recessed wall section extending radially inward from an outermost surface of said sidewall portion and terminating in a shoulder portion, said plurality of panels including a generally rectangular shaped vacuum panel portion extending a predetermined distance from said shoulder portion of said recessed wall section and defining an inner perimeter edge and a substantially oval shaped pressure panel portion connected to said inner perimeter edge of said vacuum panel portion, said pressure panel portion being movable between a first inwardly bowed shape and a second outwardly bowed shape in response to a pressure applied to an internal surface thereof, said vacuum panel portion being radially movable about said shoulder portion of said recessed wall portion.

* * * * *

UNITED STATES PATENT AND TRADEMARK OFFICE

CERTIFICATE OF CORRECTION

PATENT NO. : 6,460,714 B1
DATED : October 8, 2002
INVENTOR(S) : Kerry W. Silvers et al.

It is certified that error appears in the above-identified patent and that said Letters Patent is hereby corrected as shown below:

Column 6,
Line 1, “semi-cicular” should read -- semi-circular --.

Signed and Sealed this

Sixth Day of May, 2003

JAMES E. ROGAN
*Director of the United States Patent and Trademark Office*